United States Patent [19]

Weibel, Sr. et al.

[11] 4,287,033

[45] Sep. 1, 1981

[54] ELECTROCHEMICAL METHOD FOR REMOVING METALLIC SHEATHS

[75] Inventors: James A. Weibel, Sr., Tonawanda; Franklin A. Vassallo, Lancaster, both of N.Y.

[73] Assignee: Calspan Corporation, Columbus, Ind.

[21] Appl. No.: 139,905

[22] Filed: Apr. 14, 1980

[51] Int. Cl.[3] ..... C25F 5/00; C25F 3/14

[52] U.S. Cl. ..... 204/146; 204/129.6

[58] Field of Search ..... 204/146, 129.55, 129.6, 204/129.65

[56] References Cited

U.S. PATENT DOCUMENTS

| | | | |
|---|---|---|---|
| 2,434,286 | 1/1948 | Pfann | 204/129.55 |
| 2,739,112 | 3/1956 | Ferguson | 204/146 |
| 3,151,049 | 9/1964 | Hendry | 204/146 |
| 3,257,299 | 6/1966 | Mekjean | 204/146 |
| 3,394,063 | 7/1968 | Blume | 204/146 |
| 3,492,210 | 1/1970 | Bowers | 204/146 |
| 3,699,021 | 10/1972 | Shaffer | 204/146 |
| 4,098,659 | 7/1977 | Inverso | 204/129.65 |
| 4,111,767 | 9/1978 | Kawagishi | 204/146 |

FOREIGN PATENT DOCUMENTS

| | | | |
|---|---|---|---|
| 2541675 | 3/1977 | Fed. Rep. of Germany | 204/129.65 |
| 475955 | 5/1968 | Japan | 204/129.65 |

*Primary Examiner*—T. M. Tufariello

*Attorney, Agent, or Firm*—Biebel, French & Nauman

[57] ABSTRACT

An electrochemical stripping process is employed to selectively remove the metallic sheath from a thermocouple or resistance element without affecting the core material. The sheath is connected as a consumable anode and is inserted to a depth corresponding to the amount of the sheath to be removed. The core material is electrically isolated from the sheath and is therefore unaffected by the electrochemical process.

2 Claims, 3 Drawing Figures

ELECTROCHEMICAL METHOD FOR REMOVING METALLIC SHEATHS

BACKGROUND OF THE INVENTION

Some commercially available thermocouple elements are available in coils and are made up of two wires surrounded and separated by insulating material and located within a metallic sheath. They are available in diameters at least as small as 0.01 inches and a typical coil length is fifty feet. Heating elements made up of a resistance element in the form of a wire surrounded by insulating material and located within a metallic sheath are also commercially available. In order to attach the thermocouple wires or the resistance element in place it is necessary to remove part of the metallic sheath so as to expose the wire(s). Presently, the removal of the metallic sheathing from thermocouple and resistance heating elements consists of manual tooling operations either by mechanical cutters or by filing and grinding the sheath away. These procedures are very susceptable to causing damage, such as nicks or cuts, to the element wires themselves, and this damage becomes more common as the diameter of the sheathed wire decreases.

If commercially available stripping tools are used to remove the sheath, it is necessary to have a different tool for each size element used. Obviously, this can amount to a considerable investment.

The use of commercial tools as well as manual filing and grinding are apt to cause dimensional changes in the remaining sheath material due to the clamping action necessary for cutting operations. This dimensional deformation is usually very undesirable due to the normal design criteria of sliding the sheath through an access hole or port. The mechanical clamping and cutting action also has a tendency to loosen the packed insulating medium inside the sheath. The cutting action also has a tendency to move the sheath closer to the element wire(s) thereby increasing the possibility of electrical short circuiting. This possibility increases as the cutting tools loose their sharp edges.

SUMMARY OF THE INVENTION

The present invention uses an electrochemical process for the removal of a metallic sheath surrounding the wire(s) of a thermocouple or resistance heating element. The sheath of the element to be stripped is electrically connected as the anode and is inserted into an acid solution. The immersed metallic sheath material is quickly removed leaving the insulating material and wire(s) unaffected. The exposed insulating material can be brushed away leaving the wire(s) of the proper length.

The present invention differs from the conventional stripping operations for thermocouple and resistance heating elements in that no mechanical forces are applied to the elements as through rigid clamping, cutting or abrasion. Additionally, the present invention differs from conventional electrolytic stripping operations in that the entire immersed portion of the sheath forms the anode and is selectively stripped while the core material of the anode, which is electrically isolated, is unaffected.

It is an object of this invention to provide a method for stripping a metallic sheath from a thermocouple or resistance heating element without subjecting the sheath or its element wire(s) to damaging mechanical forces.

It is a further object of this invention to provide a method for selectively removing a sheath while avoiding the imposition of mechanical stress on the core material.

It is an additional object of this invention to provide a method for selectively removing a sheath to any desired length without damaging the core material. These objects, and others as will become apparent hereinafter, are accomplished by the present invention.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
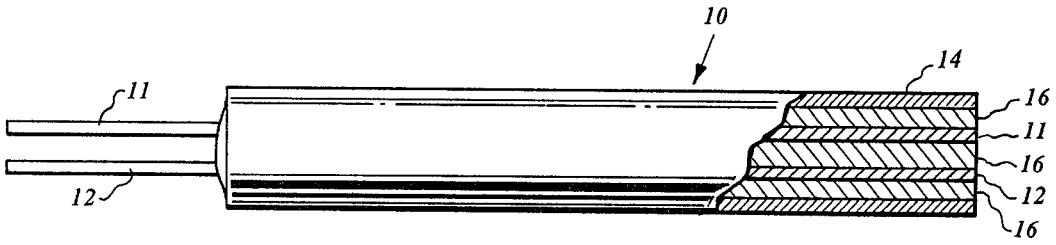
FIG. 1 is a partially sectioned view of a thermocouple element with a portion of the sheath removed.

In FIG. 1, the numeral 10 generally designates a thermocouple element. The thermocouple element 10 includes a Chromel wire 11 and an Alumel wire 12 which are located within a stainless steel sheath 14. A dielectric or insulating material 16 such as magnesium oxide powder is packed within the thermocouple element 10 to electrically isolate the wires 11 and 12 from sheath 14 and from each other. The thermocouple element 10 is illustrated as having been stripped according to the teachings of the present invention so that the desired length of wires 11 and 12 are exposed for attachment.

Figure 2:
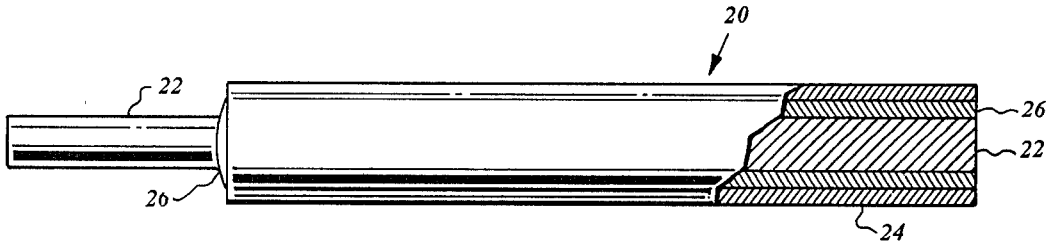
FIG. 2 is a partially sectioned view of a resistance heating element with a portion of the sheath removed.

In FIG. 2, the numeral 20 generally designates a resistance element. The resistance element 20 includes a Nichrome resistance wire 22 which is located within a stainless steel sheath 24. A dielectric or insulating material 26, such as magnesium oxide, is packed within the resistance element 20 to electrically isolate the wire 22 and the sheath 24 from each other. One end of the resistance element 10 is illustrated as having been stripped according to the teachings of the present invention to expose the desired length of wire 22 for attachment.

Figure 3:
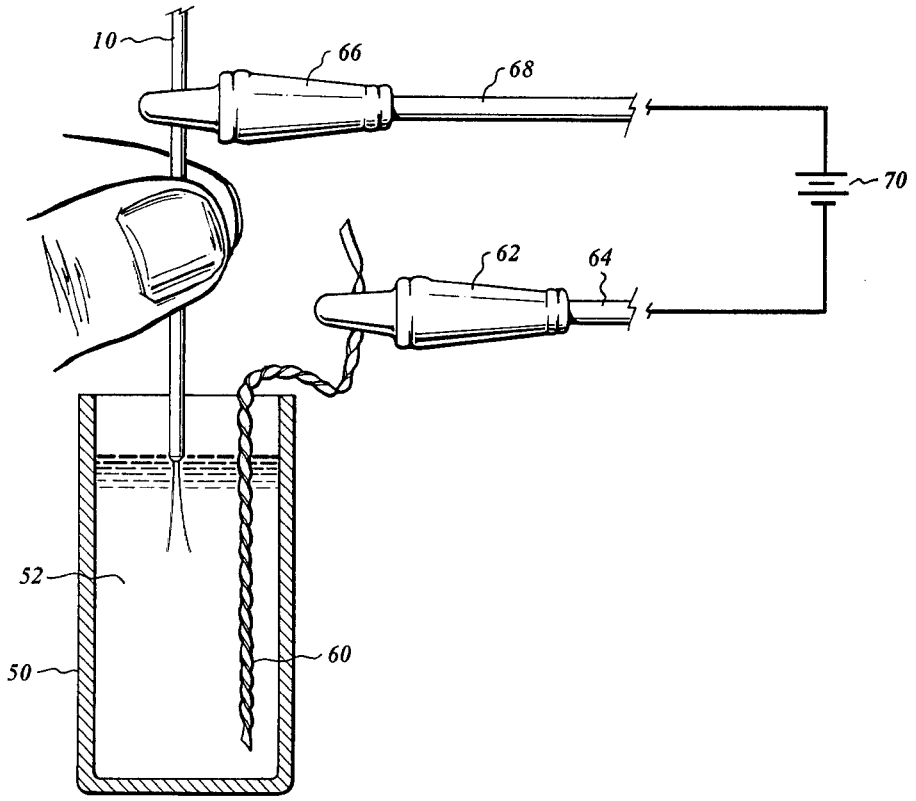
FIG. 3 is a pictorial view of apparatus for electrochemical stripping.

Apparatus for practicing of the present invention is illustrated in FIG. 3. A glass or other acid resistant container 50 is filled with an acid solution 52. For stripping a stainless steel sheath an acid solution of 30% of 37.9% HCl, 10% of 93% $H_2SO_4$ and 60% $H_2O$, by volume, has been found to be very efficient. A lead foil cathode 60 is connected to the negative terminal of battery 70 via alligator clip 62 and lead 64. The thermocouple element 10 which has been cut to the proper length is connected to the positive terminal of battery 70 via alligator clip 66 and lead 68. With the apparatus connected as described, the thermocouple element 10 is inserted into the acid solution 52 to the desired depth which is determined by the amount of sheathing to be removed. The immersed portion of the sheath 14 constitutes consumable anode and is electrochemically removed. For small (0.02 inch) diameter thermocouple elements the stripping takes place in a few seconds and completion is readily determined by the color change which occurs due to the exposure of the insulating material. The element wires 11 and 12 of thermocouple 10 are not conducting any electrical current and so they remain entirely unaffected by the process. However, if one of the wires 11 or 12 were in electrical contact with the sheath 14 due to manufacturing defects or the like, the wire would also be consumed so the process and therefore the present invention also serves to check the effectiveness of the insulating material 16 to electrically isolate the elements.

When the color change caused by the exposure of the insulating material 16 takes place the sheathed unit is withdrawn and the insulating material is brushed off the element wires 11 and 12. Ordinarily, the process would be repeated for the other end of the thermocouple 10 to expose the other ends of wires 11 and 12. The stripping of a resistance element would be similarly achieved.

Although a preferred embodiment of the present invention has been illustrated and described, changes will obviously occur to those skilled in the art. For example the stripping operation can be used where the material to be removed is electrically isolated from the structure to be left unaffected. Also, the acid mixture can be varied in components and proportions to accommodate other anode and cathode materials as is known in the art. For example, Chromel-Constantan, Platinum-Rhodium alloy and Tungsten-Rhenium alloy thermocouples may also be stripped according to the teachings of the present invention. The sheath material can be, for example, tantalum, copper aluminum or a stainless steel such as 310 and 347. The insulating material can be, for example, alumina, zirconia, beryllia or thoria. It is therefor intended that the present invention is to be limited only by the scope of the appended claims.

We claim:

1. A method for selectively removing a metallic sheath from an electrically insulated core while leaving the core unaffected and including the steps of:

connecting a suitable cathode to a source of power and inserting the cathode into an acid mixture;

connecting a metal sheath of an element as an anode and connecting the anode to the source of power; and inserting the sheath into the acid mixture to a depth corresponding to the amount of sheath to be removed whereby an electrical circuit is completed and the immersed portion of the sheath is electrochemically removed.

2. A method for selectively removing a stainless steel sheath from an element having at least one electrically isolated wire in the core of the element without affecting said at least one wire in the core and including the steps of:

connecting a lead cathode to a source of power and inserting the cathode into an acid mixture containing sulfuric acid and hydrochloric acid;

connecting the stainless steel sheath of the element as an anode and connecting the anode to the source of power; and inserting the sheath into the acid mixture to a depth corresponding to the amount of sheath to be removed whereby an electrical circuit is completed and the immersed portion of the sheath is electrochemically removed without affecting said at least one wire.

* * * * *